United States Patent [19]

Simpson et al.

[11] 4,183,534

[45] Jan. 15, 1980

[54] CONTROL APPARATUS FOR CONTROLLING A MOTION PICTURE TARGET APPARATUS

[76] Inventors: Anthony Simpson, 65 South Hill, Godalming, Surrey; Stuart M. Peterkin, 30 Leewood Way, Effingham, Surrey; Brian T. Brooksby, 156 Earlsbrook Rd., Redhill, Surrey; Harold J. Murray, 32 New Odiham Rd., Alton, Hampshire, all of England

[21] Appl. No.: 919,713

[22] Filed: Jun. 27, 1978

[51] Int. Cl.[2] ..... F41J 9/14

[52] U.S. Cl. ..... 273/105.1; 352/39

[58] Field of Search ..... 35/25; 273/105.1; 352/39, 53

[56] References Cited

U.S. PATENT DOCUMENTS

| | | | |
|---|---|---|---|
| 1,189,135 | 6/1916 | Kerestes | 273/105.1 |
| 1,281,169 | 10/1918 | Kerestes | 273/105.1 |
| 2,271,199 | 1/1942 | Mandell | 273/105.1 |

*Primary Examiner*—William H. Grieb

[57] ABSTRACT

A control apparatus for controlling operation of motion picture target apparatus, said control including servo control device for storing or calculating for each of a plurality of different types of weapons the flight times and trajectories of a projectile for a plurality of range settings of the weapon, said servo control device means producing an electrical output dependent upon flight time and trajectory, weapon selector being provided for selecting the stored or calculated information relating to a particular weapon, a stop control for selecting the range in accordance with the simulated range of the target image projected onto a screen, a stop control responsive to the produced electrical output of the servo control device dependent upon flight time of the projectile for stopping movement of a film through the projector, an audio detector for detecting the firing of a weapon for producing a start signal for the control apparatus and a solenoid responsive to the electrical output of the servo control device dependent upon the trajectory of the projectile for moving the projected image on the screen vertically upwardly.

14 Claims, 7 Drawing Figures

FIG. 4.
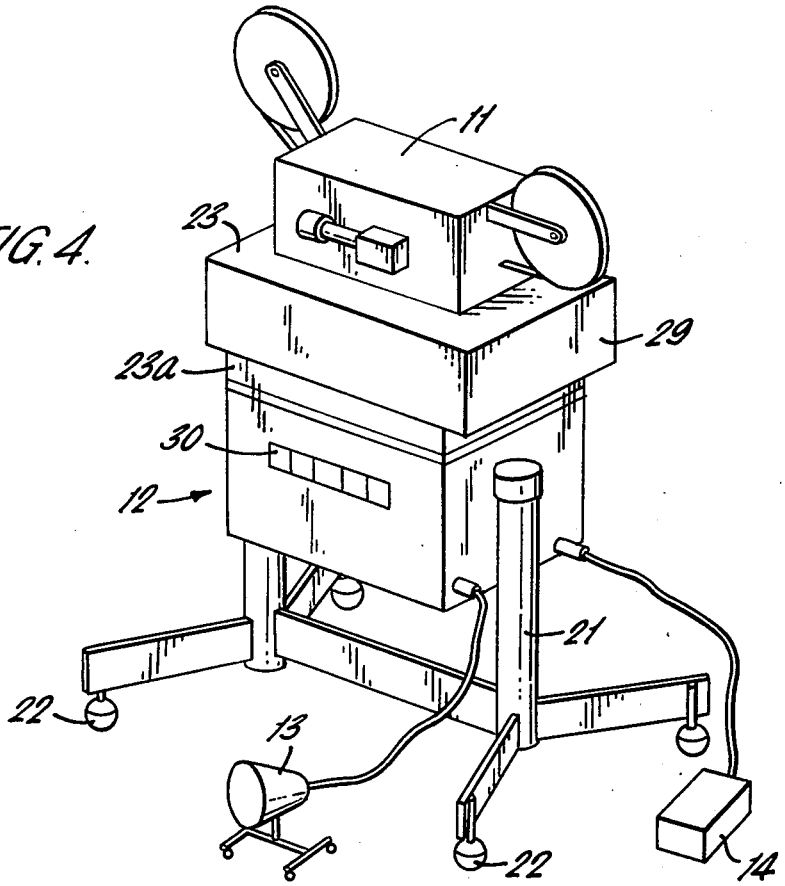
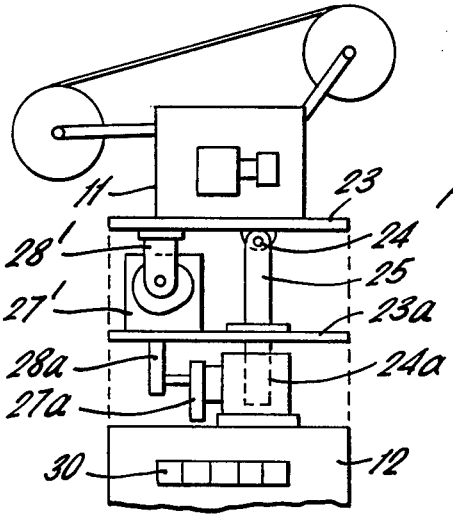
FIG. 5.

CONTROL APPARATUS FOR CONTROLLING A MOTION PICTURE TARGET APPARATUS

BACKGROUND OF THE INVENTION

This invention relates to control apparatus for controlling a motion picture target apparatus for use in the training of marksmanship, and to such target apparatus provided with control apparatus according to the present invention.

Motion picture target apparatus mainly consists of a screen formed of paper or other suitable flexible material carried by rollers and arranged so that two parallel portions of the screen are superposed one in front of the other, means for illuminating the rear side of the screen so that when both superposed portions are pierced by a projectile fired at the screen the illumination passes through the holes and indicates the result of the shot, means for moving the screen on the rollers so that said superposed portions are moved relative to each other in opposite directions to move the holes out of alignment with each other, a projector for projecting a motion picture film onto the front of the screen, means for initiating an electric signal upon the firing of a projectile at the screen and which after a predetermined period of time which simulates the travel time of a projectile stops the film in the projector, and means operable upon stopping of the film to move the projected image vertically upwardly to simulate the trajectory of the projectile. Such apparatus will hereafter be referred to as "motion picture target apparatus of the kind referred to".

In use of the apparatus of the kind referred to, the user of the weapon from which the projectile is fired sees on the screen a moving filmed image which is at a simulated range which is different from the actual constant range between the weapon and the target, i.e. the screen. For example the actual range or distance between the screen and the weapon may be 12 meters whereas the filmed range which he is aiming at may be at a simulated range of 500 meters. Therefore in order to provide for the difference between the simulated and actual ranges it is necessary to stop the film after a predetermined period of time has elapsed after firing the shot in order to simulate the travel time of the projectile and to then move the stationary projected image vertically upwardly to simulate the trajectory of the fired projectile. The stopping of the film is usually achieved by an electrical signal initiated by a microphone which picks-up the sound of the shot being fired from the weapon. The vertical movement of the stationary projected image can be carried out by providing a movable mirror system on the projector or by mounting the projector on a pivotable carrier so that the projector is tilted in order to move the stationary image vertically upwardly.

The ballistic performance of the projectiles for any given range varies from one type of weapon to another and upon the calibre of the projectile and the known apparatus of the kind referred to has to be adjusted manually so that the film stopping time and the distance of vertical movement of the image is compatible with the ballistic performance of the projectile to be fired. With known apparatus of the kind referred to the travel times and the trajectories for particular ranges had to be extracted from tables of ballistic performance for a particular projectile and weapon and a plurality of manually operable controls had to be adjusted on the apparatus before the weapon was fired. When the simulated range of the projected image varied during projection of the film an operator had to manually adjust the plurality of controls during the projection time of the film and due to the length of time taken to adjust the controls the operator either made the adjustments too late which led to inaccuracies or tended to set the controls to one setting and leave them at that setting. For this reason it was previously throught not possible to use apparatus of the kind referred to with projected film wherein the simulated range varied and it was therefore limited to the use of film where the target moved across the screen at right angles to the user of the weapon.

SUMMARY OF THE INVENTION

The invention relates as aforesaid to control apparatus for controlling a motion picture target apparatus.

An object of the present invention is to provide apparatus to enable a motion picture target apparatus to be used with film in which the simulated range of the image varies during projection.

Another object of the invention is to enable the film stopping time after a shot has been fired and the distance of vertical movement of the stopped projected image to be automatically calculated from the ballistic information of the weapon and projectile.

According to the present invention there is provided control apparatus for controlling operation of motion picture target apparatus of the kind referred to, comprising means for storing or calculating for each of a plurality of different types of weapons the flight times and trajectories of a projectile for a plurality of range settings of the weapon, said means in use of the apparatus producing electrical outputs dependent upon flight time and trajectory; means for selecting the stored or calculated information relating to a particular weapon; means for selecting the range in accordance with the simulated range of the target image projected onto the screen; means responsive to the produced electrical output of the storing or calculating means dependent upon flight time of the projectile for stopping movement of the film through the projector; means for detecting the firing of a weapon for producing a start signal, and means responsive to the produced electrical output of the storing or calculating means dependent upon the trajectory of the projectile for moving the projected image on the screen vertically upwardly.

Preferably the control apparatus includes means for automatically resetting the control apparatus to re-start movement of the film and lower the projected image after a predetermined period of time has elapsed after stopping of the film and upward movement of the image to allow for assessment of the result of the shot.

BRIEF DESCRIPTION OF THE DRAWINGS

To the accomplishment of the foregoing and selected ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings:

FIG. 4 is a diagrammatic perspective view of an alternative embodiment of console having means for tilting and skewing the projector, FIG. 5 is a side elevation of the console of FIG. 4.

DESCRIPTION OF THE PREFERRED EMBODIMENTS

Figure 1:
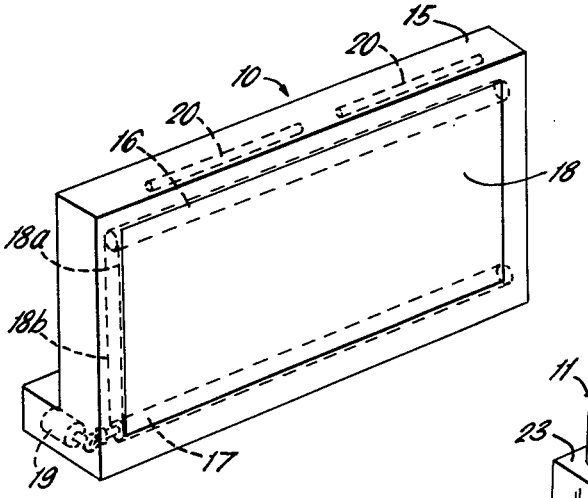
FIG. 1 is a diagrammatic perspective view of a motion picture target apparatus provided with control apparatus according to the present invention.

The motion picture target apparatus shown diagrammatically in FIG. 1 consists of a target screen 10, a projector 11, a console 12 on which the projector 11 is placed, an audio detector 13 and a remote control device 14.

The target screen 10 comprises a metal framework 15 in which are mounted an upper horizontal roller 16 and a pair of parallel horizontal rollers 17, only one of which is shown, one roller 17 carrying a supply spool of paper or other flexible material which forms a screen 18 and the other roller 17 which is not shown carrying a take-up spool. The screen 18 has two parallel portions 18*a* and 18*b* superposed one in front of the other, the portion 18*a* extending from the supply spool to the roller 16 and the portion 18*b* extending from the roller 16 to the take-up spool. The film is projected onto the portion 18*a*. Carried by the framework is a drive motor 19 for rotating the roller 17 and fluorescent tubes 20 or other suitable means are provided to illuminate the rear of the portion 18*b* of the screen 18.

Figure 2:
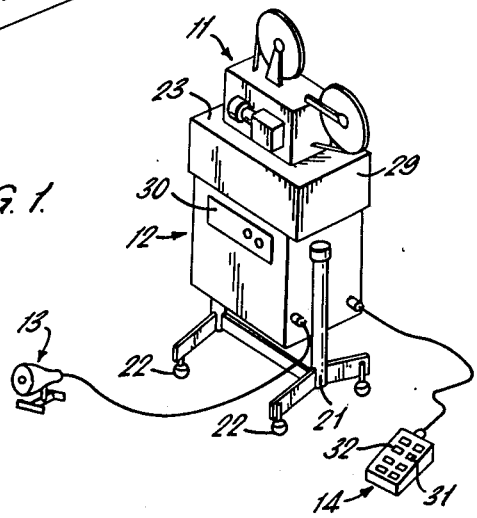
FIG. 2 is a side elevation of the projector supporting table and the apparatus for tilting the table.
Figure 2:
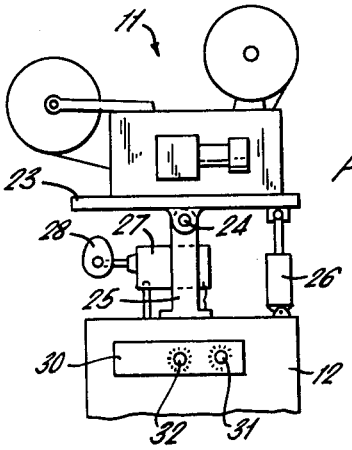

The console 12 is mounted on a support 21 movable on wheels 22 and houses part of the components of the control apparatus for controlling the projector 11 as will be described later. Mounted on the console 12 is a platform or table 23 which as shown in FIG. 2 is pivoted at 24 to a support 25. Connected between the underside of the platform 23 at one end thereof and the top of the console 12 is a solenoid 26 which serves to tilt the platform 23 about the pivot 24. Mounted on the top of the console 12 beneath the platform 23 is a motor 27 which is drivingly connected to a rotatable cam 28 which acts as a variable stop for the pivoted platform 23. Extending downwardly from the edges of the platform 23 is a peripheral cover 29 which in FIG. 2 has been removed.

The audio detector 13 is preferably in the form of a microphone which is placed near to the weapon being fired. Instead of providing an audio detector 13 it is possible to provide apparatus which is connected to the weapon which is actuated as the trigger of the weapon is actuated, but such apparatus does impair the maneuverability of the weapon.

The remote control 14 is provided with a control knob or slider 31 which is movable relative to a scale calibrated in distances, and with a selector knob 32 which can select different types of weapons and in use selects the weapon in use. These controls may be duplicated on the console 12 on a panel 30.

In use of the target apparatus the projector 11 projects a moving picture onto the screen 18. The user of the weapon then sees a moving target at a simulated range which can vary. The projectile, such as a bullet, fired from the weapon passes through both portions 18*a* and 18*b* of the screen and the aligned apertures made by the projectile allow the illumination from the tubes 20 to pass through the screen thereby clearly indicating the result of the shot. The tubes 20 may be caused to flash. The detector 13 produces an electrical signal upon the firing of the shot which, through a control system to be described later, effects stopping of the film in the projector 11 after a predetermined time interval corresponding to the time which the projectile would normally take to travel the distance simulated by the filmed target. At the end of said predetermined period of time the front end of the table or platform 23 is tilted upwardly by operating the solenoid 26, the degree of tilt being determined by the position of the cam 28, and this causes the projector 11 to be tilted upwardly so that the projected image is moved vertically on the screen 18 to simulate the trajectory of the projectile. The user of the weapon can then, for a predetermined period of time, assess the result of the shot.

Figure 3:
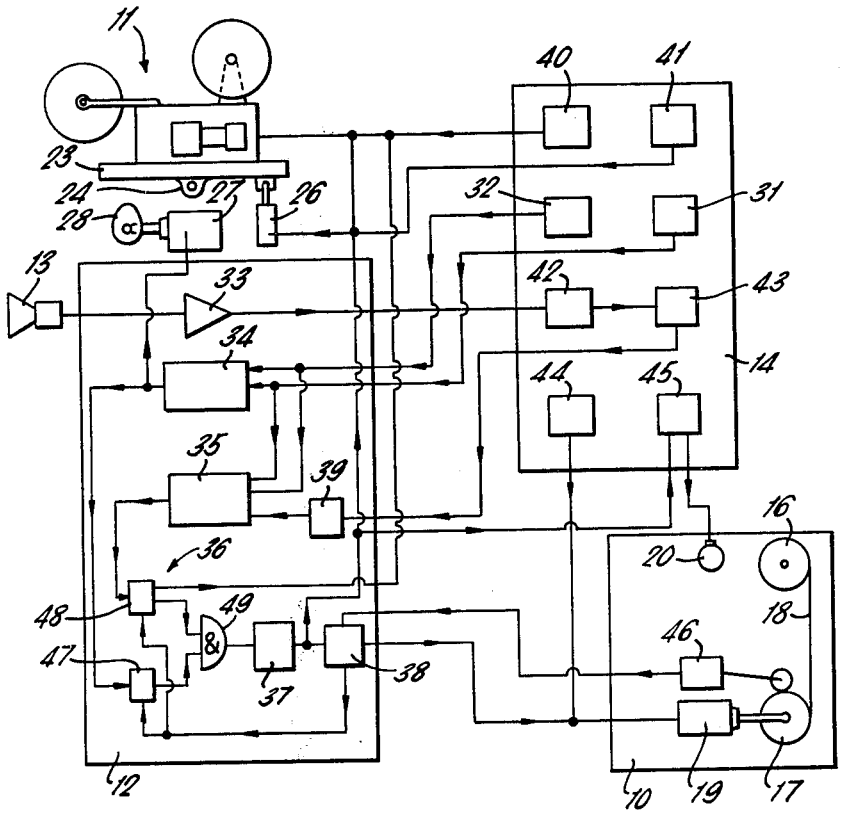
FIG. 3 is a block diagram of the circuit and components of the control apparatus.

The control system for the apparatus of FIGS. 1 and 2 is shown in FIG. 3. Provided in the console 12 is an amplifier 33 for amplifying the electrical signal produced by the audio detector 13, a servo control device 34, a flight time timer 35, a bi-stable flip-flop circuit 36, an assessment timer 37, a counter 38 and a crystal clock 39. Provided on the remote control 14 is a projector control 40, an assessment control 41, the weapon selector and indicator 32, the range selector 31, a test unit 42, a shot counter and display 43, a drive control 44 for the motor 19 and a control 45 for the lamps 20. The screen 10 is provided with a meter 46.

The servo control device 34 can be in the form of an information store and reader which stores ballistic information concerning the trajectory of a projectile for a plurality of ranges of use. This information is provided for a plurality of different types of weapons and the type of weapon can be selected by the weapon selector 32. Therefore for each weapon selected the device 34 has stored information relating to the trajectory of the projectile fire from that type of weapon for each range selected by the range selector 31. The flight time timer 35 also stores information relating to the flight time of the projectile of the selected weapon for each range selected by the range selector 31.

The devices 34 and 35 instead of being in the form of information stores and readers may each be in the form of a computer which automatically calculates the values of trajectory and flight time for the particular selected weapon and range.

The control system of FIG. 3 operates as follows:

The instructor selects by means of the weapon selector 32 the type of weapon which is to be used and this causes the trajectory servo control 34 and the flight time timer 35 to read or calculate the desired information in accordance with the range selected by the range control 31 and each device 34, 35 will produce an output signal. The audio detector 13 produces a signal upon the firing of the weapon and this signal is amplified in amplifier 33 and fed via the test control 42 and shot counter 43 to start the crystal clock 39. The clock 39 feeds clock pulses to the timer 35.

The signals from the weapon selector 32 and range control 31 are simultaneously fed to the trajectory servo control 34 and the timer 35 so that they read or calculate the ballistic information of the selected weapon at the selected range. The output from the device 34 is supplied to the motor 27 to rotate the cam 28 to a position determined by the output signal and is supplied to bi-stable flip-flop 47 of the circuit 36. At this time the signal will not pass through the flip-flop 47. After a period of time determined by the timer 35 it will produce an output signal which is supplied to the bi-stable flip-flop 48 of the circuit 36. As there is now a signal at each flip-flop 47 and 48 the signal from the timer 35 is passed through the flip-flop 48 to operate a stop control on the projector 11 which stops the projected film in the gate of the projector 11. The signal which passes through flip-flop 48 is also fed to the solenoid 26 which pivots the table 23 into contact with the cam 28 to raise the projected image on the screen. The signals from devices 34 and 35 pass through the flip-flops 47 and 48 and pass through an AND-gate 49 to actuate the timer 37. After a predetermined period of time determined by the timer 37, the timer 37 produces an output which passes through the counter 38 to operate the motor 19 to wind the screen 18 by an amount sufficient to bring the holes produced therein by the projectile out of alignment. The amount of screen wound-on the take-up roll is counted by the meter 46 and counter 38 which then produces a reset signal to reset the circuit 36. The output from the timer 37 is fed to the projector stop control and solenoid 26 to return the table to the horizontal position.

Figure 6:
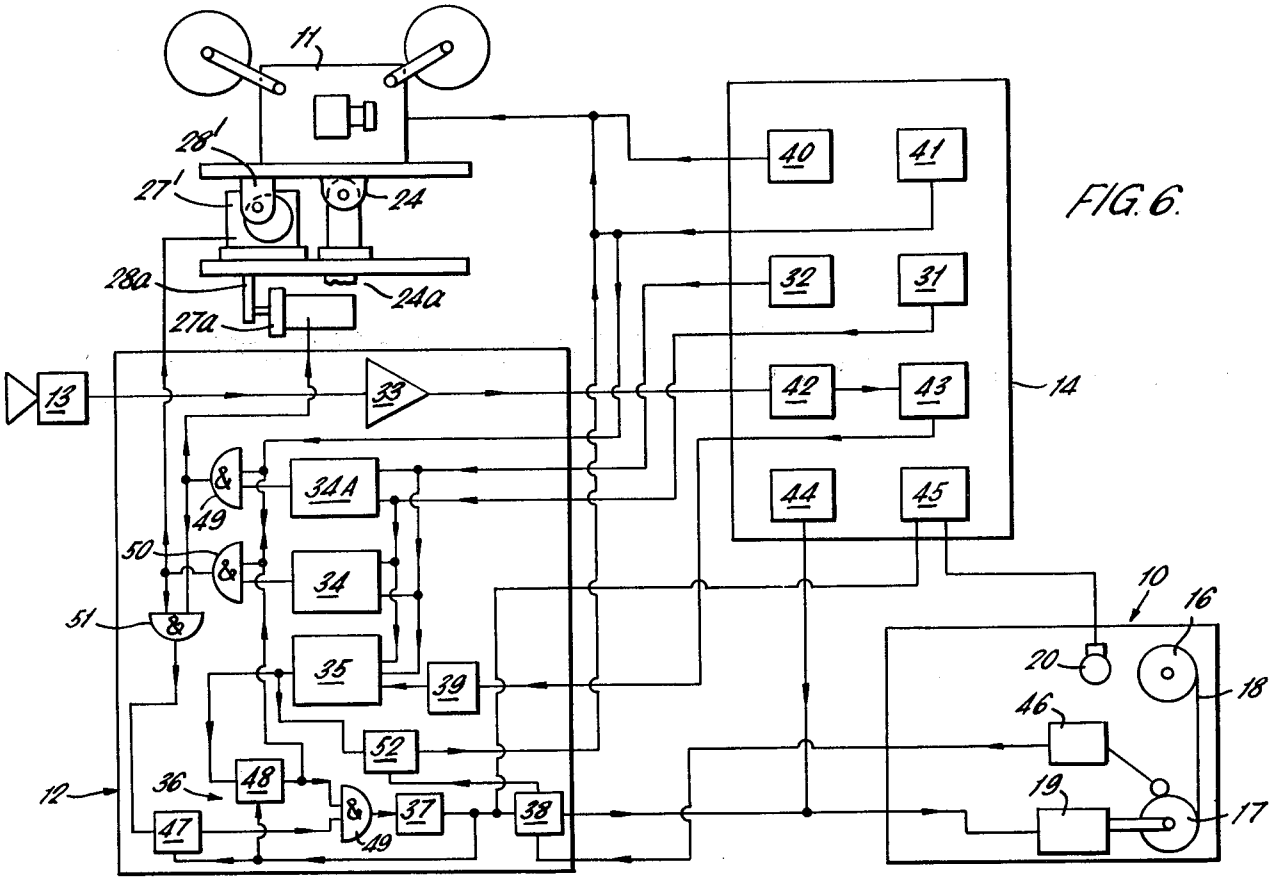
FIG. 6 is a block diagram of the circuit and components of the apparatus of FIGS. 4 and 5.

FIGS. 4 to 6 illustrate a modified embodiment of the apparatus in which the console 12 is provided with means for skewing the projector 11 horizontally to assimulate drift of a projectile due to an simulate wind. Mounted on the console 12 is a skew platform **23*a* which is pivoted vertically on a central support column 24*a* to provide a horizontal movement. A servo motor 27*a* is connected to the slew platform 23*a* via an eccentric linkage 28*a*. When the shaft of the servo motor 27*a* rotates, the eccentric linkage 28*a* pulls the rear of the platform 23*a* to one side and this of course also causes the tilt platform 23 and projector 11** to swing horizontally and the projected image is moved horizontally on the screen.

The tilt platform 23 of FIGS. 4 to 6 is pivoted at 24 in the same manner as described with reference to FIGS. 1 to 3. However in the embodiment of FIGS. 4 to 6 a servo motor 27' is connected to the platform 23 via a linkage 28' connected eccentrically to a disc driven by the servo motor 27'.

With this modified embodiment at the same moment when the tilt platform 23 is tilted by the servo motor 27' and the linkage 28' the skew platform **23*a*** is rotated horizontally, to the left or right depending on the wind speed and direction as set by the instructor using control setting knobs on the console. This causes the projected image to move horizontally on the screen to simulate the wind drift of the projectile.

The control circuit of FIG. 6 is similar to that of FIG. 3 but is modified to provide for the operation of the skew platform **24*a*. Included in the circuit is a skew servo control device 34*a* which can be in the form of an information store and reader which stores ballistic information concerning the trajectory of a projectile for certain wind speeds and wind directions. The device 34*a* instead of being in the form of an information store and reader may be in the form of a computer which automatically calculates the drift of the projectile for a given wind speed and direction. The instructor selects the direction and speed of wind and the device 34*a* will produce an output signal. The signals from the weapon selector 32 and range control 31 are simultaneously fed to the tilt servo control 34, skew servo control 34*a* and the timer 35** so that they read or calculate the ballistic information of the selected weapon at the selected range.

The output of the devices 34 and **34*a* are gated by AND gates 49 and 50. After a period of time determined by timer 35 it will produced an output signal which is supplied to the bi-stable flip-flop 48 of the circuit 36 and to bi-stable 52. The output of flip-flop 48 initiates tilt and skew movement and goes to AND gates 49' and 50. The output of timer 35 also goes to a bi-stable 52. The output of bi-stable 52 stops the projected film in the gate of the projector 11. When the tilt movement and skew movement is complete the output of AND gate 51 sets bi-stable 47. The output of bi-stable 47 goes to AND gate 49'. The output of gate 49' then initiates operation of timer 37. During the assessment time of timer 37 the screen lights are turned on via control 45. After the assessment time of timer 37 the bi-stables 47 and 48 are reset, resetting the tilt platform 23 and the skew platform 23*a* back into their original positions, and the counter 38 is set. The output of counter 38 then operates screen motor 19 to wind the screen 18 by an amount sufficient to bring the holes produced therein by the projectile out of alignment. The amount of screen wound on the take-up roll is counted by the meter 46 and counter 38 which then produces a reset signal to reset the bi-stable 52 which restores the projector 11**.

Figure 7:
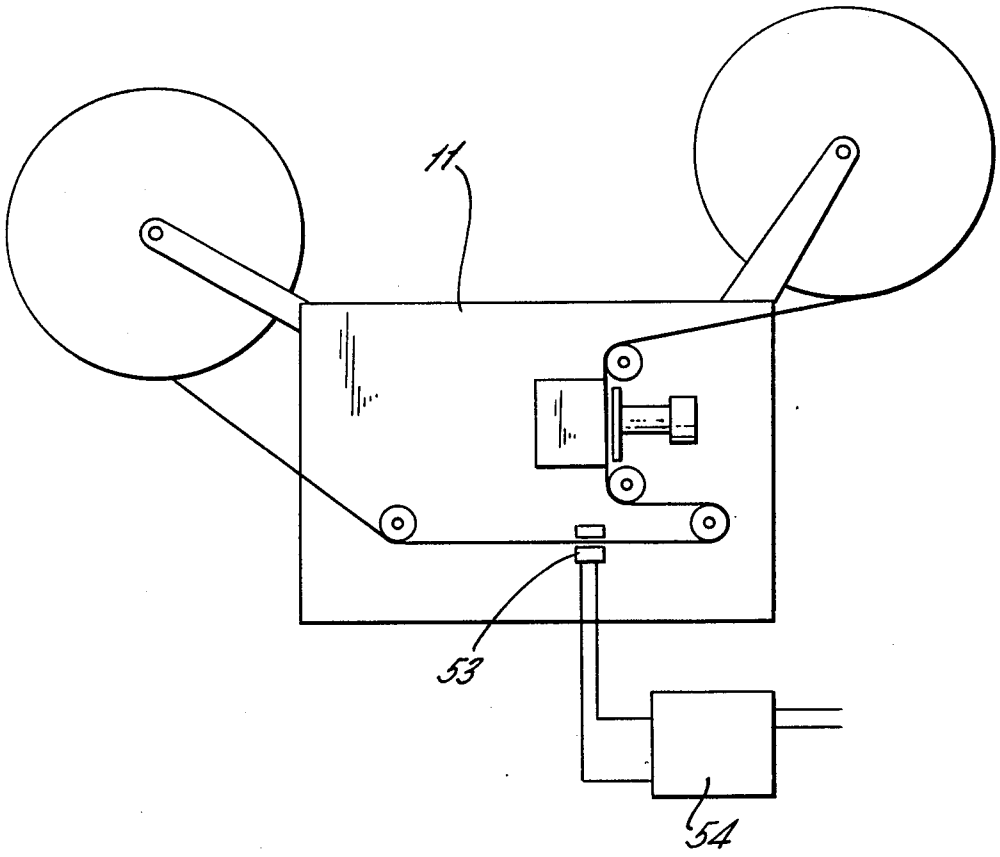
FIG. 7 is a diagram of a projector provided with automatic range reading facility.

The range control 31 in both described embodiments may be manually adjusted during the projection time of the film so that the selected range is adjusted in accordance with the simulated or apparent range of the target image on the screen 18. It is however possible for the range control 31 to be operated automatically from range information provided on the film being projected. This is shown in FIG. 7. The range control may be switched to automatic range control. This unit is in the console 12 and switched into use from the remote control 14. A sensor 53 is fitted to the projector 11 and the outputs of the sensor 53 are taken to a serial to parallel date convertor 54 the output of which goes to devices 34, **34*a* and 35**.

Instead of the pivotable table 23 (FIG. 1) or pivotable and swingable tables 23, **23*a* (FIG. 4) and associated components for effecting tilting and swinging thereof it is possible for the projection 11 to have a movable mirror system which is moved by the output signal from trajectory control device 34 or devices 34 and 34*a*** by means of a solenoid or servo motor.

It will be appreciated that the control device of both embodiments is automatically directly settable in accordance with range and a selected weapon which avoids the need for having to calculate flight times and trajectories from information extracted from tables as was previously the case with known apparatus.

We therefore particularly point out and distinctly claim as our invention:

1. Control apparatus for controlling operation of a motion picture target apparatus having a screen, and a projector for projecting a motion picture film of a target image onto the screen, said control apparatus comprising means for storing or calculating for each of a plurality of different types of weapons the flight times and trajectories of a projectile for a plurality of range settings of the weapons, said means in use of the apparatus producing electrical outputs dependent upon flight time and trajectory; means for selecting the stored or calculated information relating to a particular weapon; means for selecting the range in accordance with the simulated range of the target image projected onto the screen; means responsive to the produced electrical output of the storing or calculating means dependent upon flight time of the projectile for stopping movement of the film through the projector; means for detecting the firing of a weapon for producing a start signal; and means responsive to the produced electrical output of the storing or calculating means dependent upon the trajectory of the projectile for moving the projected image on the screen vertically upward.

2. Control apparatus as claimed in claim 1, including a means for storing information or calculating information concerned with lateral drift of a projectile due to wind and which in use of the apparatus produces an electrical output signal dependent of drift and including means responsive to said output signal for moving the projected image horizontally.

3. Control apparatus as claimed in claim 1, including means for automatically resetting the control apparatus to re-start movement of the film and restore the projected image to its original position on the screen after a predetermined period of time has elapsed after stopping of the film and effecting movement of the image to allow for assessment of the result of the shot.

4. Control apparatus as claimed in claim 3 wherein said screen can be pierced by a projectile and is movable on rollers, and means are provided for moving the screen, said apparatus including means for initiating operation of the means for moving the screen on the rollers so as to move the holes produced in the screen by the projectile out of alignment before the control apparatus is reset.

5. Control apparatus as claimed in claim 1, wherein said means for producing a start signal comprises an audio detector for producing an electrical signal upon firing of a weapon and an amplifier for amplifying said signal.

6. Control apparatus as claimed in claim 1, wherein said storing or calculating means comprises a first information store or computer for providing an electrical output signal dependent upon trajectory of a projectile for a selected range and a second information store or computer for providing an electrical output signal dependent upon the flight time of the projectile for said selected range, the output side of each store or computer being electrically connected to a bi-stable flip-flop device.

7. Control apparatus as claimed in claim 1, wherein the means for moving the projected image vertically on the screen comprises a pivotable platform on which the projector is mounted, a rotatable cam, a motor for rotating said cam, said motor being controlled in dependence upon the output produced in accordance with trajectory to move the cam to a desired position, and means for pivoting the platform to bring it into contact with the cam when said cam is in the desired position when an output signal is produced dependent upon flight time of the projectile.

8. Control apparatus as claimed in claim 2, wherein the means for moving the projected image horizontally on the screen comprises a rotatable platform on which the means for moving the image vertically is mounted, said platform being connected by a linkage to a servo motor, said motor being controlled in dependence upon the output of said means for storing information or calculating information concerned with lateral drift.

9. Control apparatus as claimed in claim 1, wherein the means for moving the projected image on the screen comprises a mirror system, a servo motor or solenoid being provided for moving the mirrors of the system in response to the produced electrical output of the storing or calculating means.

10. Control apparatus as claimed in claim 1, wherein said storing or calculating means comprises a first information store or computer for providing an electrical output signal dependent upon trajectory of a projectile for a selected range and a second information store or computer for providing an electrical output signal dependent upon the flight time of the projectile for said selected range, the output side of each store or computer being electrically connected to a bi-stable flip-flop device, and including means for supplying clock pulses to the second information store or computer.

11. Control apparatus as claimed in claim 1, wherein the combined output signals from the store or calculating means is supplied to a timer which produces an output reset signal after a predetermined period of time after stopping of the film and the output side of the timer is connected to a gate which enables a signal to operate said means for moving the screen before the projector is re-started and the projected image restored to its original position.

12. Control apparatus as claimed in claim 1, wherein the simulate range of the target image is automatically supplied to the means for selecting range from range information provided on the film.

13. Control apparatus as claimed in claim 1, wherein the simulate range of the target image is automatically supplied to the means for selecting range from range information provided on the film, and wherein means are provided for reading the range information provided on the film and supplying an electrical output dependent upon the range information read to the means for storing or calculating lateral drift due to wind.

14. Motion picture target apparatus having a screen movable on rollers and of a material adapted to be pierced by a projectile, a projector for projecting a motion picture of a target image onto the screen, means for moving said screen, and further provided with control apparatus as claimed in claim 1.

* * * * *

UNITED STATES PATENT OFFICE

CERTIFICATE OF CORRECTION

Patent No. 4,183,534 Dated January 15, 1980

Inventor(s) Anthony Simpson; Stuart Murray Peterkin; Brian Thomas Brooksby and Harold John Murray It is certified that error appears in the above-identified patent and that said Letters Patent are hereby corrected as shown below:

column 6, line 41, "date" should read --data-- column 8, claim 12, line 39, "simulate" should read --simulated-- column 8, claim 13, line 43, "simulate" should read -- simulated --

Signed and Sealed this

Eighth Day of July 1980

[SEAL]

Attest:

SIDNEY A. DIAMOND

Attesting Officer

Commissioner of Patents and Trademarks